US011585202B2

(12) United States Patent
Machocki et al.

(10) Patent No.: US 11,585,202 B2
(45) Date of Patent: Feb. 21, 2023

(54) METHOD AND SYSTEM FOR OPTIMIZING FIELD DEVELOPMENT

(71) Applicant: SAUDI ARABIAN OIL COMPANY, Dhahran (SA)

(72) Inventors: Krzysztof Karol Machocki, Aberdeen (GB); Chinthaka Gooneratne, Dhahran (SA); Ayodeji Abegunde, Dhahran (SA); Arturo Magana-Mora, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 245 days.

(21) Appl. No.: 16/887,691

(22) Filed: May 29, 2020

(65) Prior Publication Data

US 2021/0372262 A1 Dec. 2, 2021

(51) Int. Cl.

| | |
|---|---|
| ***E21B 44/00*** | (2006.01) |
| ***E21B 7/04*** | (2006.01) |
| ***E21B 21/08*** | (2006.01) |
| ***E21B 44/04*** | (2006.01) |
| ***E21B 45/00*** | (2006.01) |

(Continued)

(52) U.S. Cl.

CPC ..... *E21B 44/00* (2013.01); *E21B 7/04* (2013.01); *E21B 21/08* (2013.01); *E21B 43/30* (2013.01);

(Continued)

(58) Field of Classification Search

CPC . E21B 7/04; E21B 43/30; E21B 44/00; E21B 47/12; E21B 2200/20

See application file for complete search history.

(56) References Cited

U.S. PATENT DOCUMENTS 6,026,912 A 2/2000 King et al.
7,142,986 B2 11/2006 Moran (Continued)

FOREIGN PATENT DOCUMENTS

CN 108756848 B 5/2019
RU 2588526 C2 6/2016

(Continued)

OTHER PUBLICATIONS

International Search Report and Written Opinion issued in corresponding International Patent Application No. PCT/US/2020/044231, dated Feb. 18, 2021 (15 pages).

*Primary Examiner* — Tara Schimpf
(74) *Attorney, Agent, or Firm* — Osha Bergman Watanabe & Burton LLP

(57) ABSTRACT

A method for optimizing a drilling roadmap may include identifying an optimal bottom hole assembly (BHA) setup and drilling parameters for a well located in a field. The BHA setup may be based on historical simulation data of the field and drilling roadmap information. The drilling roadmap information may include initial drilling instructions for implementing the drilling roadmap. The method may include implementing and tracking the drilling roadmap at the well. The drilling roadmap may be based on a location of the well on the field and a type of other applications being performed on the field. The method may include obtaining sensor collected data to determine an accuracy of implementation of the drilling roadmap. The accuracy may be determined based on a comparison between tracked drilling parameters and simulated drilling parameters.

20 Claims, 10 Drawing Sheets

(51) Int. Cl.

| | |
|---|---|
| ***E21B 43/30*** | (2006.01) |
| *E21B 47/07* | (2012.01) |
| *E21B 47/06* | (2012.01) |
| *E21B 47/12* | (2012.01) |

(52) U.S. Cl.
CPC ..... *E21B 44/04* (2013.01); *E21B 45/00* (2013.01); *E21B 47/06* (2013.01); *E21B 47/07* (2020.05); *E21B 47/12* (2013.01); *E21B 2200/20* (2020.05)

(56) References Cited

U.S. PATENT DOCUMENTS 9,022,140 B2 * 5/2015 Marx ..... E21B 41/0092 175/50
2004/0256152 A1 12/2004 Dashevskiy et al.
2009/0084545 A1 4/2009 Banerjee et al.
2009/0152005 A1 6/2009 Chapman et al.
2012/0217067 A1 * 8/2012 Mebane, III ..... E21B 44/02 175/57
2016/0153266 A1 6/2016 Rashid et al.
2016/0333673 A1 11/2016 Anno et al.
2019/0243025 A1 8/2019 Wlodarczyk et al.
2020/0040719 A1 * 2/2020 Maniar ..... E21B 41/00
2020/0063546 A1 2/2020 Weideman et al.
2020/0080409 A1 * 3/2020 Haggerty ..... E21B 7/04

FOREIGN PATENT DOCUMENTS

WO 2004/090285 A1 10/2004
WO 2017059152 A1 4/2017
WO 2018/067131 A1 4/2018
WO 2019217131 A1 11/2019

* cited by examiner

METHOD AND SYSTEM FOR OPTIMIZING FIELD DEVELOPMENT

BACKGROUND

Currently, when a field operator company is performing drilling activities to develop an oil or gas field, drilling contractors are called to execute drilling operations. The drilling contractors normally operate on different types of equipment: drilling rigs, top drives, or different sensor packages. The different types of equipment implemented across different drilling operations require corresponding specialized personnel with skill sets varying for each drilling crew. Such variables in equipment and skill sets normally contribute to inconsistencies in drilling parameters implemented at each drilling site. As such, different drilling crews may respond in different ways to address unexpected behavior (i.e., high lateral down hole vibrations, stick and slips, or other problems that contribute to reduced rate of penetration (ROP)) or changes in drilling parameters implemented in a common field. On some occasions, a miscalculated decision to address unexpected behavior or a change in drilling parameters may cause significant problems that may in turn lead to pipe twist-offs or fatigue failures. Such significant problems during drilling may result in extensive non-productive time for the field.

SUMMARY

In general, in one aspect, embodiments disclosed herein relate to a method for optimizing a drilling roadmap. The method includes identifying an optimal bottom hole assembly (BHA) setup and drilling parameters for a well located in a field. The BHA setup is based on historical simulation data of the field and drilling roadmap information. The drilling roadmap information includes initial drilling instructions for implementing the drilling roadmap. The method includes implementing and tracking the drilling roadmap at the well. The drilling roadmap is based on a location of the well on the field and a type of other applications being performed on the field. The method includes obtaining sensor collected data to determine an accuracy of implementation of the drilling roadmap. The accuracy is determined based on a comparison between tracked drilling parameters and simulated drilling parameters. The method includes updating the drilling roadmap based on the sensor collected data and the accuracy. The method includes optimizing an updated drilling roadmap by changing the drilling parameters at the well.

In general, in one aspect, embodiments disclosed herein relate to a method for optimizing a drilling roadmap. The method includes obtaining an optimal bottom hole assembly (BHA) setups and drilling parameters for various wells in a field, each well having a corresponding BHA setup and corresponding drilling parameters. The method includes implementing the BHA setups and the drilling parameters for each well. The method includes tracking the drilling parameters at each well. The method includes obtaining sensor collected data from each well to determine an accuracy of implementation of the corresponding drilling parameters. The method includes updating the drilling roadmap based on the sensor collected data and the accuracy. The method includes optimizing an updated drilling roadmap by changing the drilling parameters at each well and by integrating the updated drilling roadmap into a machine learning algorithm. The method includes validating the updated drilling roadmap onto the machine learning algorithm.

In general, in one aspect, embodiments disclosed herein relate to a system operating with an optimized drilling road. The system includes a downhole data collection tool (DDCT) and a surface data collection tool (SDCT) that identify an optimal bottom hole assembly (BHA) setup and drilling parameters for a well located in a field. The BHA setup is based on historical simulation data of the field and drilling roadmap information. The drilling roadmap information includes initial drilling instructions for implementing the drilling roadmap. The system includes a downhole confirmation tool (DCT) that implements and tracks the drilling roadmap at the well. The drilling roadmap is based on a location of the well on the field and a type of other applications being performed on the field. The system includes a data gathering and analysis system (DGAS) that obtains sensor collected data to determine an accuracy of implementation of the drilling roadmap. The accuracy is determined based on a comparison between tracked drilling parameters and simulated drilling parameters. The system includes communication systems that indicate updating the drilling roadmap based on the sensor collected data and the accuracy. The system includes a control system that optimizes an updated drilling roadmap by changing the drilling parameters at the well.

The foregoing general description and the following detailed description are exemplary and are intended to provide an overview or framework for understanding the nature of what is claimed. The accompanying drawings are included to provide further understanding and are incorporated in and constitute a part of the specification. The drawings illustrate various embodiments and together with the description serve to explain principles and operations of an apparatus.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
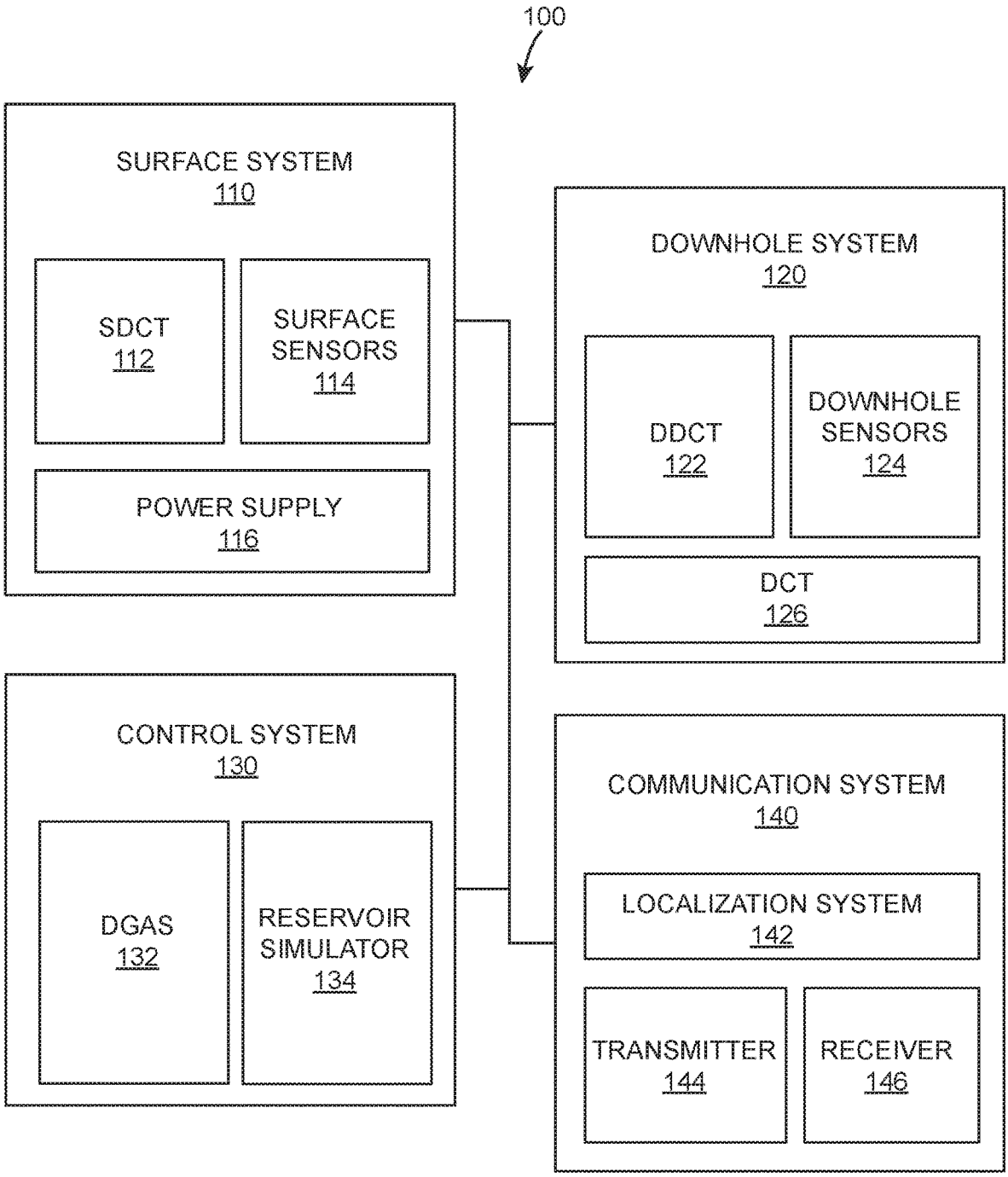
FIG. 1 shows a block diagram of a system in accordance with one or more embodiments.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. For the sake of continuity, and in the interest of conciseness, same or similar reference characters may be used for same or similar objects in multiple figures.

In oil or gas fields, multiple rigs may perform drilling following different bottom hole assembly (BHA) setups and drilling parameters while drilling. The rigs may implement similar or different drilling parameters based on their location in the field and based on the efficacy of their corresponding systems. Some rigs may have sophisticated systems (i.e., full rig optimization systems) measuring multiple parameters on field environments in a surface area and a sub-surface area. The sub-surface area may be scanned through downhole operations in a well. Some rigs may have less sophisticated systems (i.e., reduced rig optimization systems) having less sensors for downhole operations when compared to the sophisticated systems. As such, it is advantageous to develop a process for coordinating drilling parameters between the various systems across a single field such that sensory data obtained by one rig may be shared with the rest of the rigs in a field. To this point, fields may be optimized by controlling drilling procedures using shared drilling parameters between various rig systems in real time.

The field development may be optimized by using multiple rigs with different setups to consistently deliver most optimal system inputs, such as controlling drilling parameters. Controlling and coordinating drilling parameters allows for best ROP and energy transfer across all of the rigs in the field, which leads to a reduction of unwanted downhole events. As such, a method and a system for optimizing field development may include capabilities to analyze drill stem behavior based on data from downhole sensors in at least one of the rigs and broadcast the results of the at least one rig to other rigs in an area that do not necessarily have such downhole sensors. Specifically, a system that communicates and shares the parameters of one rig with other rigs in the area may be the most optimal parameters that should be used for particular activities to achieve best performance across several rigs.

If inconsistencies occur during drilling, the most optimal drilling parameters may be required to change. Inconsistencies may refer to unexpected changes in any one rig during operations. These changes may be in a particular well and they may cause expensive fixes and large amounts of delayed production time. Altogether, lacking a method to optimize field development may lead to additional costs related to late production. In some cases, deviating from an original plan by delays might be only few days; in other occasions where more serious problems are encountered (such as pipes twist offs or fatigue failures), additional costs of loss of equipment and Non-Productive Time (NPT) might be added when trying to deal with the issues.

In this regard, the method described herein identifies a most optimal BHA setup and drilling parameters for a well, which may then be used to create an initial drilling roadmap when drilling multiple wells and developing an oil or gas field. Machine learning algorithms based on deep learning capabilities may be developed to improve drilling parameters such as weight on bit (WOB), ROP, torque, vibration, drilling fluid hydraulics such as wellbore cleaning, stability and integrity, and wellbore steering while drilling directional wells. The method may incorporate these models in real time for rig systems to simulate drilling personnel's response and automate decision making processes with minimal input from drilling personnel. As such, drilling personnel may be located off site and may be only required to intervene when absolutely needed (i.e., when an onsite repair requires supervision or guidance). If only one rig system in a field follows the optimization method, this rig may coordinate its drilling parameters with multiple wells (i.e., more than two) within a field. This coordination allows the field to be significantly improved as drilling parameters may be copied and processed across several rigs, instead of evaluating each rig individually. As mentioned above, the simulations may be implemented through machine learning techniques such that deep learning platforms may provide immediate decision making in cases where the learning algorithms may provide a clear solution to a drilling inconsistency.

FIG. 1 shows a block diagram including different components of a rig system 100. The rig system 100 may include a surface system 110, a downhole system 120, a control system 130, and a communication system 140. These systems may be hardware and/or software configured to process sensory inputs and historical data into drilling parameters relating to field optimization, to analyze the drilling parameters based on current environmental data on a surface area and on a downhole area of the well, and to implement updated drilling parameters to affect drilling in real time across the field. The rig system 100 may be disposed in a well environment near a reservoir located in a subsurface formation. In the case of a hydrocarbon well, the reservoir may include a portion of the formation that includes a subsurface pool of hydrocarbons, such as oil and gas.

The surface system 110 may include a surface data collection tool (SDCT) 112, various surface sensors 114, and a power supply 116. The SDCT 112 may be software and hardware configured to measure and to collect surface oilfield data, which may include pipe information such as pipe vibrations (axial and lateral), torque, tension, compression, temperature inside and outside distribution/collection pipes used for liquid distribution/collection of materials to/from the well, and pressure or fluid flow speed inside the distribution/collection pipes. The SDCT 112 may be mounted at the Top Drive such that the SDCT 112 may connect to a last drill pipe connection, or to a tool that may connected to the last drill pipe connection (i.e., a saver sub).

Further, the SDCT 112 may not be required to travel down a hole when drilling a well and additional pipes are added to a drill string. In some embodiments the SDCT 112 may be mounted in a different location, e.g., on the top drive itself rather than on the drill string. In some embodiments, surface sensors 114 may be configured to communicate with the SDCT 112, when the SDCT 112 is connected with the last drill pipe connection. Certain connections from the communication system 140 may be placed on the Top Drive along the SDCT 112. In some embodiments, the SDCT 112 may be a collar clamped around the drill stem on the surface and will not travel down the hole. In such embodiment, the collar might have options to be either mounted to a part of the drill stem that will not travel down the hole, or part of the drill stem that is traveling down the hole. Further, such clamp might be moved upwards as needed to prevent traveling below a rotary table, which may be obtained during the connection. In some embodiments, the measurements might be taken by a camera-based measurement mounted away from the top drive, but pointing in a direction of the drill stem to collect information relating to vibrations, rotation, weight on bit, top drive positioning, or additional information exchanged with the surface sensors 114. Additional measurements may be obtained from a drill floor, where the surface sensors 114 may not be connected and may not be directed onto the top drive. Such measurements may be related to mud pumps or cuttings returning from the well.

The SDCT 112 may measure and transmit sensory information to a Data Gathering and Analysis System (DGAS) 132. This information may include some downhole pipe behavior, such as variations in torque stick and slips (i.e., vibrations) from down the hole. In some embodiments, the SDCT 112 may send data to the DGAS 132 for faster data processing when the DGAS 132 is on the surface. The communication to the DGAS 132 may be performed by the SDCT 112 using wireless and/or wired communication schemes when transmitting data. The communication schemes may include applications involving Bluetooth, Wi-fi, mobile broadband, or near field communications. In some embodiments, a combination of two or more methods may be used (i.e. Wi-Fi with cable connections or near field communication with cable with GSM). The surface sensors 114 may be coupled to the SDCT 112 to aid in collecting and processing of sensory information. The surface sensors 114 may include a surface pressure sensor operable to sense the pressure of production regulated by a control system 130. The surface sensors 114 may include a surface temperature sensor including, for example, a wellhead temperature sensor that senses a temperature of production flowing through or otherwise located in the wellhead, referred to as the "wellhead temperature" (Twh). The flow rate sensor may include hardware that senses the flow rate of production (Qwh) passing through the wellhead.

The power supply 116 may be a battery system or wired system for providing electrical energy to the rig system 100. In some embodiments, the battery system may be one or more generators installed on a rig site (not shown). The wired system may be connections coupling power grid lines to the rig system 100 (not shown).

The downhole system 120 may include a downhole data collection tool (DDCT) 122, various downhole sensors 124, and a downhole confirmation tool 126. The DDCT 122 may be software and hardware configured to measure and to collect downhole oilfield data which may include pipe vibrations (i.e., axial and lateral), torque, tension, compression, drag, temperature inside and outside, pressure inside and outside, fluid flow speed inside and outside, pipe bending, distance to a nearest wall. The DDCT 122 may be fitted in a strategic place in a drill stem, such as in a combination of a drill pipe, a BHA, and any other tools used to make a drill bit turn at a bottom of a wellbore. Some locations may include being directly behind the drill bit, behind/in front of drill collars, inside drill pipes, or strategically placed between BHA tools (not shown). The BHA tools may include underreamers, roller reamers, motors, RSS tools, stabilizers, anti-stick and slip tools, among others.

In some embodiments, multiple DDCT 122 may be used and placed in more than one strategic position, such as behind the bit, before and after strategic tools, and in drill pipes. The DDCT 122 may be coupled to downhole sensors 124. The downhole sensors 124 may be hardware and software configured for acquiring drilling parameters relating to the downhole environment and for keeping track of the mechanical parameters of the drilling assembly. The downhole sensors 124 may be used to identify any downhole behavior (i.e., expected or unexpected) that may contribute to loss of energy along the drill string or premature destruction of drill stem components. The downhole sensors 124 may offer the capability to measure all, a subset, or most parameters relating to geological and directional data of fluids among pipes. Data from the downhole sensors 124 are transmitted back to surface for analysis using commonly known industry telemetry systems. Such transmission may be through a wired pipe or a wireless exchange service such as acoustic telemetry, mud pulse, or Electro Magnetic transmissions. In some embodiments, one or more carriers might be dropped inside the drill string and circulate down to the exit port to the annular side and travel on the annular side recording data. Further, a data carrier from downhole sensors 124 may be released from the DDCT 122 and travel on the annular side upwards to the point of collection. Such downhole sensors 124 may be collected once returned back to surface and data from them may be downloaded for further analysis. The DDCT 122 may be self-powered by battery or may be generated energy down the hole by some field proven energy harvesting method such as fluid turbine. In some embodiments, power may be delivered from surface with the aid of cable (i.e., wired drill pipes). As such, the DDCT 122 may be downloaded into the DGAS 132 of the control system 130 such that data may be processed down the hole and only limited signals may be sent back to surface allowing to take corrective actions.

Further, the DDCT 122 may be coupled to the SDCT 112 such that data collected from surface environments and downhole environments may also be available. The DDCT 122 may be integrated with a downhole energy harvester, packaged for survival in a high temperature environment (>200° C.) and placed along the drill string to form a high temperature, self-powered downhole communication system, to transmit data from the bottom of a well to the surface. In some embodiments, multiple DDCT 122 may be integrated to form a smart drill pipe that provides real time distributed sensing data. The data transmission method may be low power wireless technologies such as low-power Wi-Fi, Bluetooth, Bluetooth Low Energy, or ZigBee. Higher frequencies may allow a better signal and a longer transmission distance. However, the rig system 100 must be optimized since attenuation and power requirements may also be higher at higher frequencies. The antennas may be directional, omni-directional, and point-to-point. There may also be planar antennas such as monopole, dipole, inverted, ring, spiral, meander, and patch antennas. The power to the DDCT 122 may be provided by an energy harvester. The energy harvester may be based on usage of downhole hydraulic/mechanical energies to generate electricity using generating schemes (i.e., piezoelectric, triboelectric, magnetostrictive, thermoelectric, or pyroelectric). The energy harvester may consist of a rectifier to change analog signals to digital signals and a capacitor to store the electrical energy. The power management may be performed by a microcontroller unit (i.e., a processor), which may handle power requirements of the downhole sensors 124 and a communication module. In this case, the communication module may consist of a transceiver and an antenna.

The downhole confirmation tool 126 may be similar to the DDCT 122 and it may be used to confirm input parameters used to drill a particular well. The downhole confirmation tool 126 may cause similar drill stem behavior to a best case scenario selected by analyzing inputs and outputs from the DDCT 122 during an operational input heat map generation. In some embodiments, the downhole confirmation tool 126 may have preprogrammed ranges of particular expected values for different readings (i.e., vibrations, rotation, bending, torsional oscillation, or pressure). In a case where the measured values may differ from the optimal pipe behavior, then the downhole confirmation tool 126 may send a signal to the surface to warn about a deviation from the preprogrammed plan and allow for corrective actions. Such signal to the surface may be sent using mud pulse telemetry, pressure drop caused by opening port, wired telemetry, or acoustic telemetry. The downhole confirmation tool 126 may also map real time geological and directional information while drilling a live well based on pre-programmed historical data. The downhole confirmation tool 126 may also have an array of data carriers that may be released on command, by a pre-programmed timer or according to an output from a machine learning tool loaded onto the downhole confirmation tool 126.

The control system 130 may include the DGAS 132 and a reservoir simulator 134. The control system 130 may be in communication with the surface sensors 114 and the downhole sensors 124 to sense characteristics of substances in the well. The characteristics may include, for example, pressure, temperature, and flow rate of production flowing through pipes or other conduits across the well.

The DGAS 132 may collect data from the surface sensors 114 and the downhole sensors 124 distributed by the rig system 100 from the SDCT 112, the DDCT 122, and the downhole confirmation tool 126. The method and system may include a network of dynamic interlinked components that utilizes additional smart sensors/devices to acquire data, actuators that respond to sensor information, communication to facilitate data transfer between devices and artificial intelligence, machine learning, and big data analytics to process, enrich and present the data in a way to initiate action. Robust artificial intelligent methods, including machine learning and deep learning models, may be used to find non-linear relationships between surface and downhole drilling parameters. As such, models may be used to input missing downhole data from surface data for a rig lacking the DDCT 122. As such, rigs containing both the DDCT 122 and the SDCT 112 may be used to train a model able to estimate downhole data for other rigs. Advantageously, the rig optimization system 100 may provide cost savings by avoiding the use of downhole tools in all rigs. In some embodiments, data may have to be fed periodically to the DGAS 132 by downloading data from the DDCT 122 when tools may be disposed at the surface of the field. In some embodiments, data may be released from a downhole tool periodically to the surface. As such, the DGAS 132 may be placed on each rig in the field being developed. In some rigs, the DGAS 132 may have limited functions (i.e. limited to transmit data to the DGAS 132 located at a central rig). That is, the DGAS 132 may communicate with other DGASs in the field using the communication system 140. In some embodiments, data may be sent to a cloud service using the communication system 140. In such embodiments, data analysis may be performed by the cloud service such that the data processing results may be sent back to a main rig controlling the communication system 140.

In some embodiments, the reservoir simulator 134 may include hardware and/or software with functionality for generating one or more reservoir models regarding the formation and/or performing one or more reservoir simulations. For example, the reservoir simulator 134 may perform drilling analysis and estimation. Further, the reservoir simulator 134 may store well logs and data regarding core samples for performing simulations. While the reservoir simulator 134 may be disposed at a well site, embodiments are contemplated where reservoir simulation systems are located away from well sites. In some embodiments, the reservoir simulator 134 may include a computer system disposed to estimate drilling procedures across one or more rigs. The computer system may also provide real time estimation, based on the feedback from the surface sensors 114 and the downhole sensors 124.

The communication system 140 may include a localization system 142, a transmitter 144, and a receiver 146. The transmitter 144 and the receiver 146 may transmit and receive communication signals, respectively. Specifically, the transmitter 144 and the receiver 146 may communicate with one or more communication systems deployed across the field or at a remote location. The transmitter 144 and the receiver 146 may communicate wirelessly using a wide range of frequencies. In particular, high or ultrahigh frequencies (i.e., between 10 KHz to 10 GHz) may be implemented. The localization system 142 may include one or more geospatial location identification components that collect information associated with a geospatial location of the rig system 100.

In some embodiments, the communication system 140 may be fitted to each rig in the field, allowing for communicating of results from each DGAS 132 to any device or personnel inputting drilling parameters into the one or more drilling systems. Communication of the most optimal drilling input drilling parameters to each driller may be performed through display or sound methods, and a combination of both visual and sound methods. In some embodiments, if any types of automated or semi-automated drill equipment are fitted to the rig to control the input automatically, the communication of the most optimal parameters may be performed directly into the automated driller system itself such that no actions from driller may be required. Further, a confirmation from drilling personnel may be required before accepting new drilling inputs by the automated/semi-automated drilling system. Additionally, the communication system 140 may allow communicating the most optimal drilling parameters results from one rig to other rigs with similar communication systems. Each rig may transmit the most optimal drilling parameter results to the main rig. Alternatively each rig may communicate with any rigs in the area by sending and receiving signals from the rigs in the field that are performing similar tasks (i.e., drilling similar hole sections). In some embodiments, the communication system 140 located at the main rig may not be on the rig but in the cloud. The communication system 140 may use all available methods for data transmission available including wireless or wired. The communication system 140 may implement technologies such as Wi-Fi, Cable, or GSM signals to process data from all sources or most related sources in the field. The information may also be transmitted by very small aperture terminal (VSAT) or cellular standard technology such as Long-Term Evolution (LTE) or New Radio (NR) protocols to a private cloud service. The cloud service may act as an internal corporate central data center. The security, access, and privacy frameworks may be defined by internal policies and procedures, which may be same as for the sensor network and the communication system 140 at the main rig. While the DGAS 132 may rapidly process data performing decision making in real-time, the cloud service may be used to store historical data and also perform large scale deep learning and big data analytics.

Figure 2:
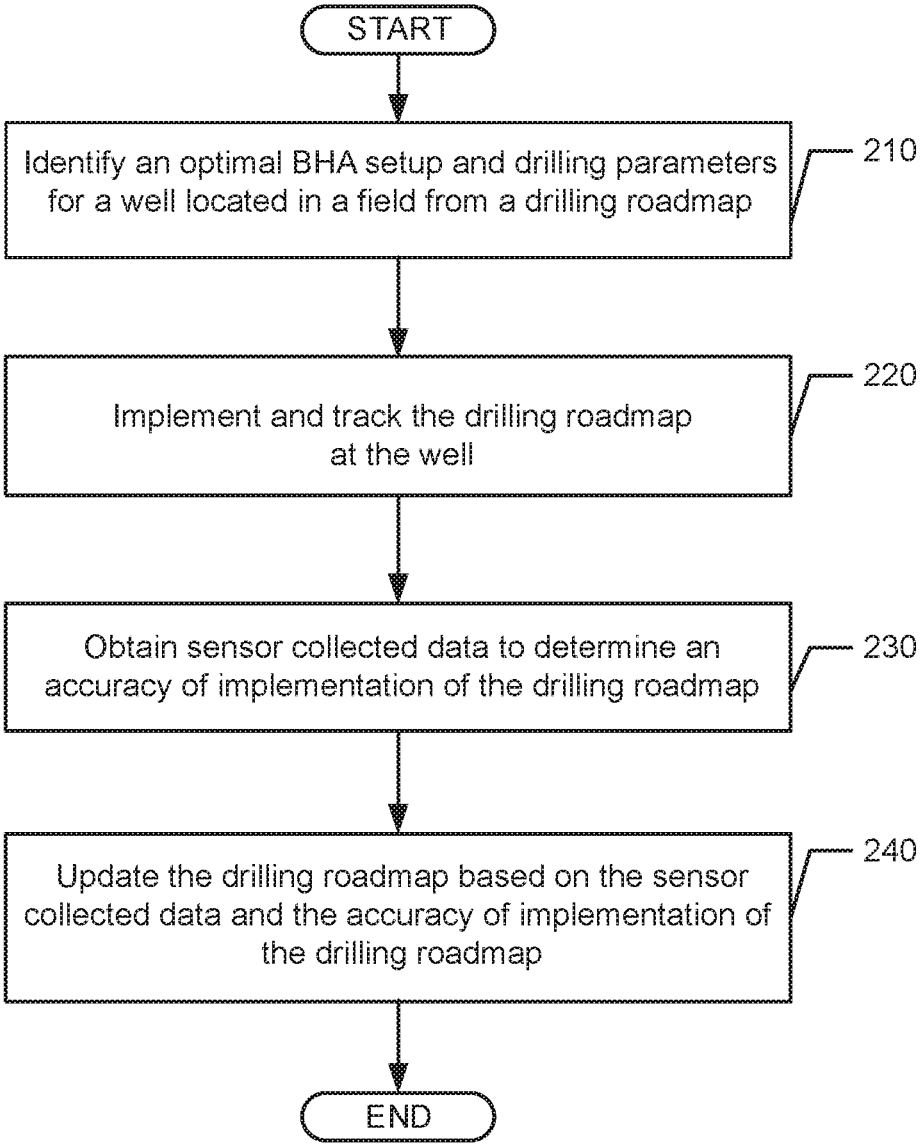
FIG. 2 shows a flowchart according to one or more embodiments.

FIG. 2 shows a flowchart according to one or more embodiments. One or more blocks in FIG. 2 may be performed by one or more components as previously described in FIG. 1 (for example, the various systems). While the various acts shown in FIG. 2 are presented and described sequentially, one of ordinary skill in the art will appreciate that some or all of the acts may be executed in different orders, some or all of the acts may be combined or omitted, and some or all of the acts may be executed in parallel. Furthermore, the acts may be performed actively or passively.

At 210, an optimal BHA setup and drilling parameters may be identified for a well located in an oilfield. The BHA setup may be based on historical simulation data and drilling roadmap information. The drilling parameters may be drilling instructions established in a drilling roadmap. The drilling roadmap may be a compilation of instructions and/or commands to be implemented by one or more of the components in the rig system 100. The drilling roadmap may be updated, revised, and corrected over a period of time or upon immediate request.

At 220, the drilling roadmap may be tracked and implemented at the well. The drilling roadmap may be based on a location of the well in the field and a type of other applications being performed in the field. Other applications may be other implementations of data collection performed in the field. These applications may be a type unrelated to the operations of any one specific rig while still collecting data about the surface or the sub-surface of the field. Further, these applications may be a type related to the operations of a specific rig. The drilling roadmap may be affected by changes in the well occurring throughout the drilling process or by modifications occurring at a distance on nearby rigs or at sites involving the other applications. These two types of applications will be explained in reference to FIG. 3.

At 230, sensor collected data may be obtained to determine an accuracy of implementation of the drilling roadmap. The accuracy may be determined based on a comparison between tracked drilling parameters and simulated drilling parameters. The drilling parameters may be parameters associated with a current state of the well while the simulated drilling parameters may be a result of reservoir simulations being applied to a specific well.

At 240, the drilling roadmap may be updated based on the sensor collected data and the accuracy. The drilling roadmap may be constantly optimized through updates and machine learning techniques, as described above.

Figure 3:
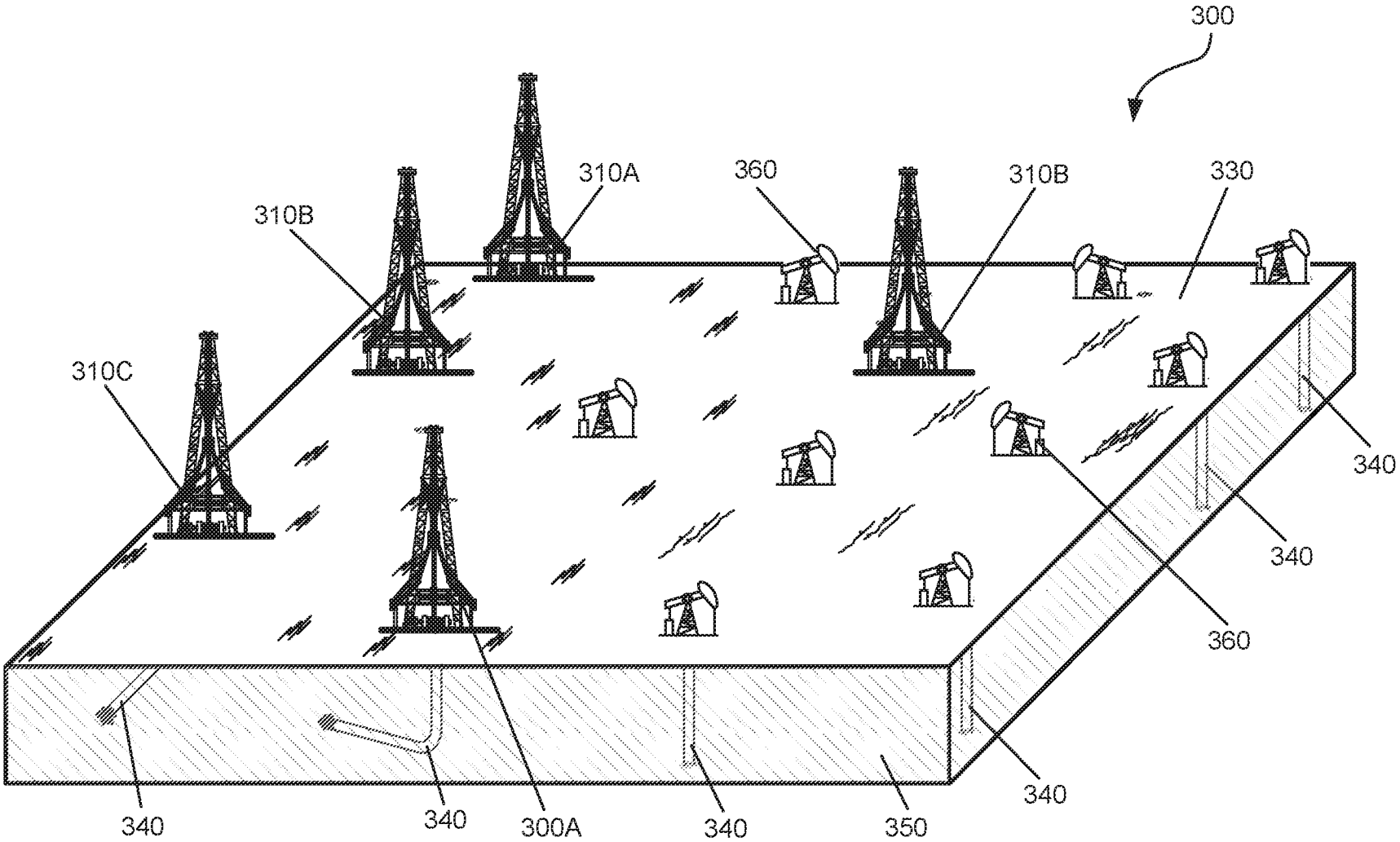
FIG. 3 shows a field environment according to one or more embodiments.

FIG. 3 illustrates an example of an oilfield environment 300 including various wells extending from a surface area 330 into a subterranean area 350. The wells may be drilling wells 310A-310C or production wells 320. Drilling wells 310A-310C may be wells being drilled using drilling piping 340. The drilling piping 340 may include several of the systems discussed with respect to FIG. 1. Production wells 320 may be wells currently used for production.

The oilfield environment 300 may include various surface elements, such as various pumps 360 disposed atop each production well 340 in the surface area 330. The pumps 360 may be standalone pumps connected to fluid tanks or containers for storing materials (not shown), such as materials used in well production. Further, the oilfield environment 300 may include various surface elements, such as various wellheads (not shown) disposed atop each well in the surface area 330. In the case of the drilling wells 310A-310C, the wells may be drilled while production wells 340 are active in nearby areas of the oilfield. In one or more embodiments, as described above, different drilling wells may follow different drilling processes. That is, the drilling wells may include a main drilling well serving with the rig system 100. In one or more embodiments, data collection applications may be of two types. One type may involve a production well 340 that may collect surface and/or sub-surface production information. Another type may involve the drilling wells 310A-310C that may collect surface and/or sub-surface drilling information.

Figure 4A:
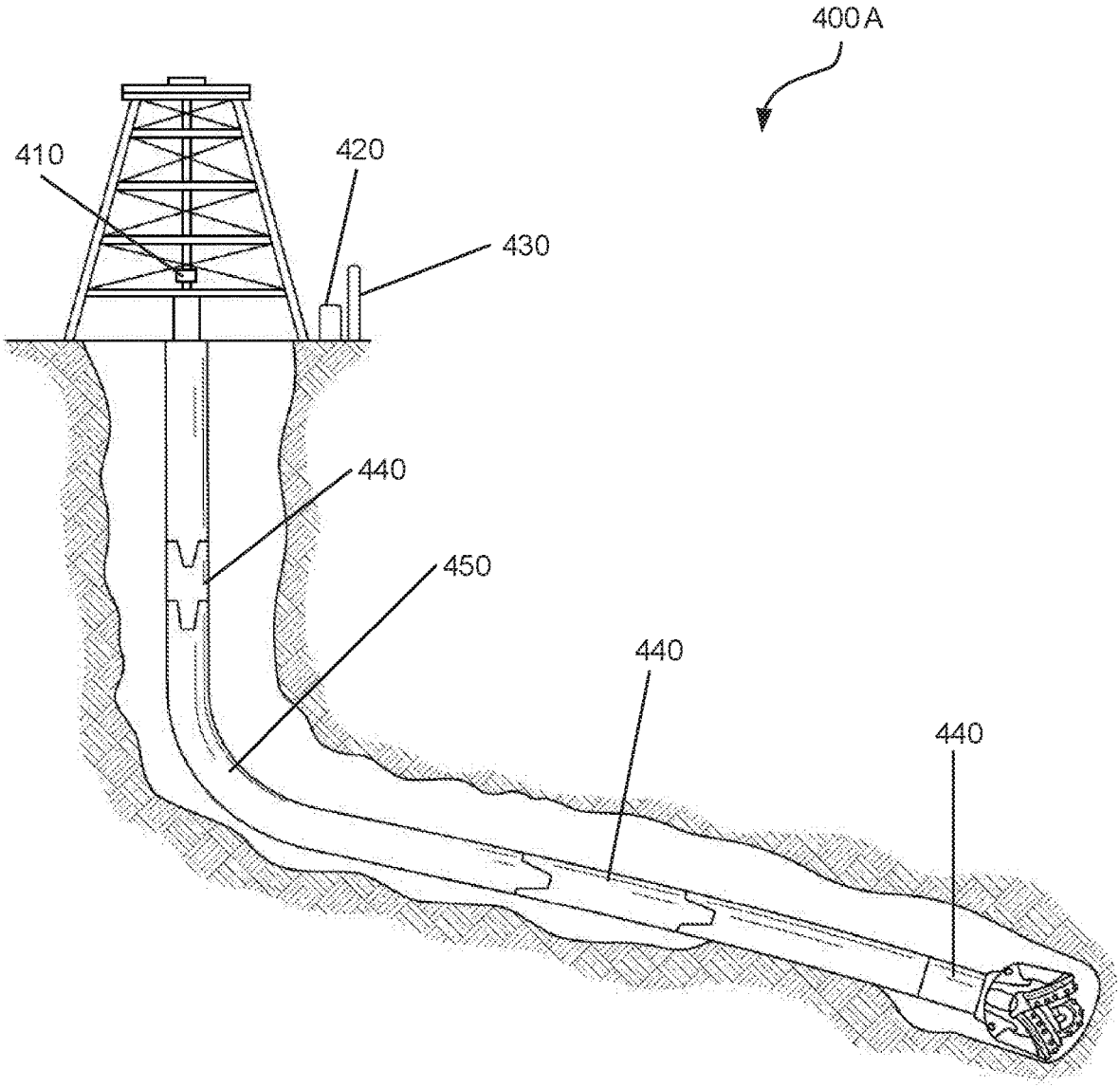
FIGS. 4A to 4C show a system according to one or more embodiments.
Figure 4B:
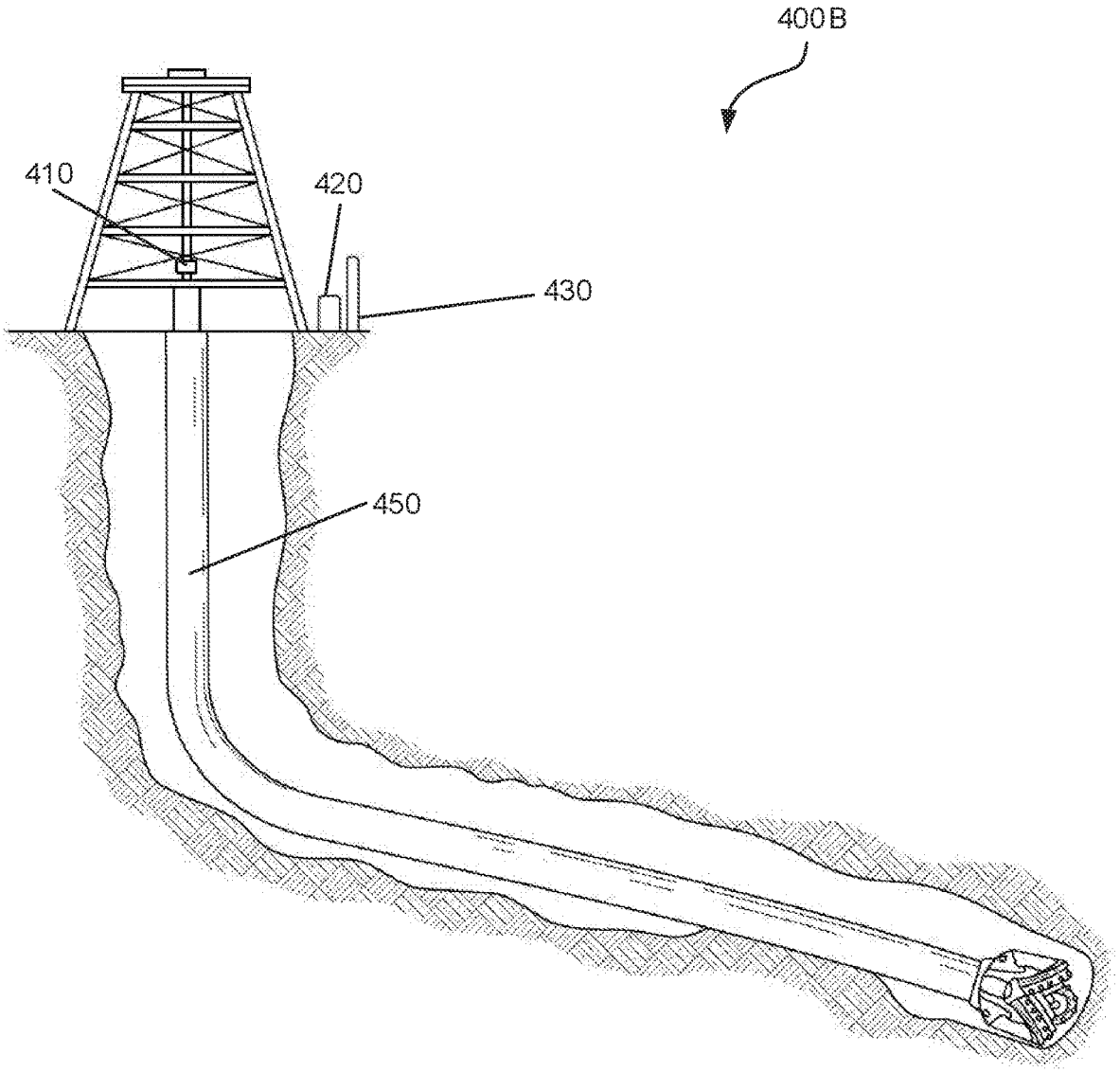
Figure 4C:
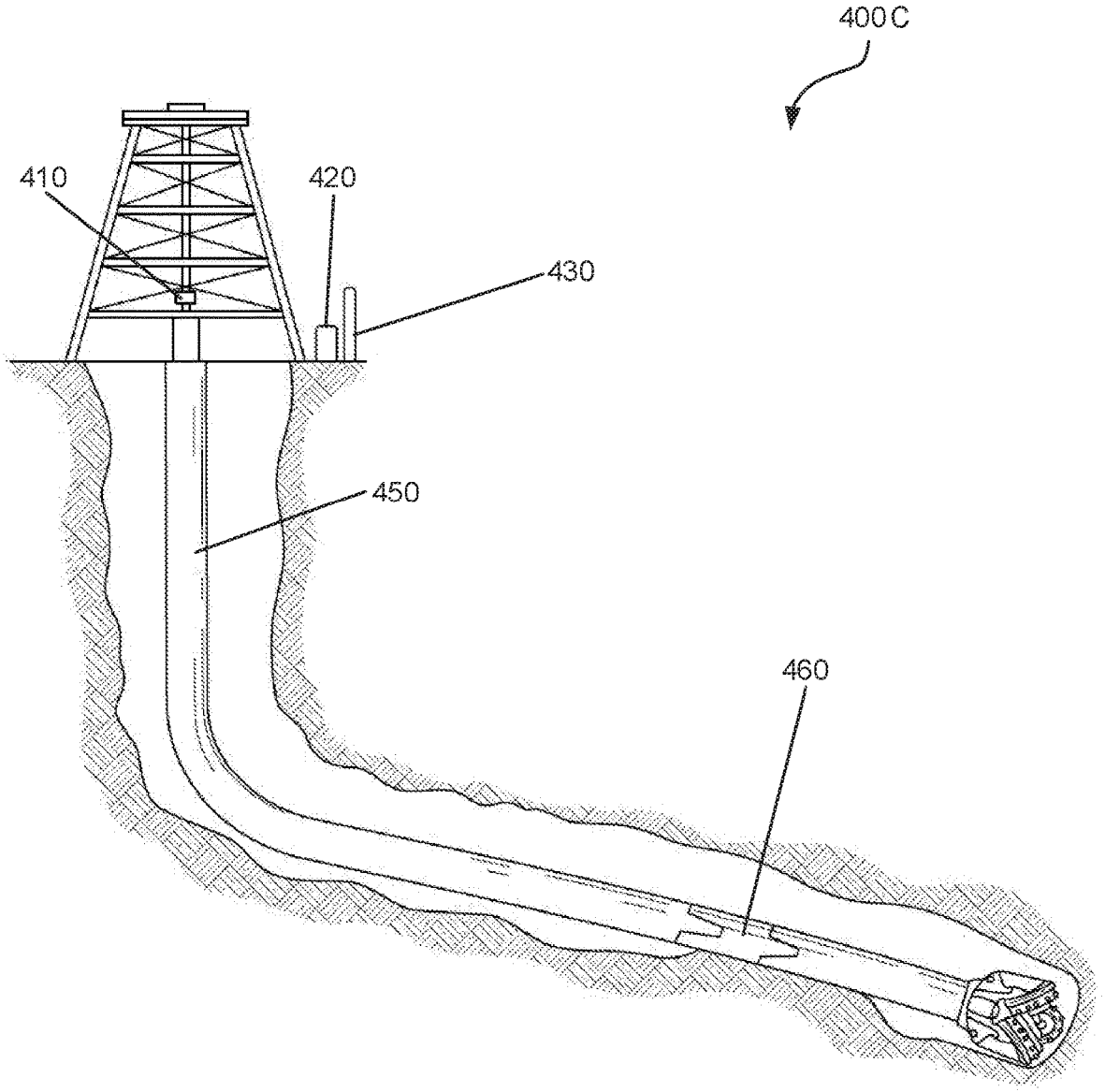

FIGS. 4A to 4C show cross-sections for rig systems 400A-400C according to one or more embodiments. The rig systems 400A-400C may be full rig systems or reduced rig systems as described above. The full rig systems may include a DDCT 440, a SDCT 410, a DGAS 420, and a communication system 430. The reduced rig system may include a SDCT 410, a DGAS 420, and a communication system 430. In some embodiments, the full rig system or the reduced rig system may include a downhole confirmation tool 460. In some embodiments, there may be various reduced rig systems and only one full rig system. The importance of the full rig system is that the full rig system includes a DDCT 440, which may provide sub-surface drilling information feedback to several other rig systems and, in some cases, to an entire field of rig systems.

Among the rig systems 400A-400C, rig system 400A may be a full rig system such that, at certain depths operational parameters heat maps may be generated to measure the system's downhole behavior. A heat map may be a graphical representation of data where values are depicted by color. In this case, an operational parameter heat map may enable visualization and understanding of complex data relating to the operational parameters at a predetermined depth. Input parameters may be searched to prevent any excessive unwanted drill stem behavior down the hole that may lead to failure of drill string, drilling components, or excessively wearing of the bit. The downhole sensors 124 may record drill stem behavior at strategic locations and following strategic drilling parameters input from a control system on the surface. In this case, an operation parameters heat map may be generated to find the most optimal input parameters for drilling in a particular field. The heat maps may focus on increasing the drill string durability or optimizing the ROP. For high BHA durability, the system may search for minimum vibrations and torsional oscillations that may lead to damaging the BHA components or drill stem 450. Typically, in high ROP heat map the other factors may be more important and higher level of vibrations may be accepted in order to reach faster the targeted depth. Heat map optimization scope may be selected specifically for particular hole sections of a well or for an entire field (i.e., large hole sections), drill with maximum available ROP, but smaller/deeper hole section drill with maximum focus on durability.

Among the rig systems 400A-400C, rig systems 400B and 400C may be reduced rig systems such that these rigs may copy the BHA setup and input parameters from rig system 400A and perform similar drilling operations. In this case, the SDCT 410 of rig system 400B may act as a high-level reference point and may have similar readings and data frequency to the SDCT 410 of rig system 400A. Such reading may be WOB, Torque, Pressure, RPM, Vibrations, or ROP, among others. If the majority of such readings are similar, then an assumption may be made that the rig system 400B is drilling with similar vibrations down the hole to the rig system 400A, meaning that similar durability of drilling equipment or ROP may be achieved. In some embodiments, a downhole confirmation tool 460 might be deployed to make sure the pipe behavior from rig system 400A is similar during activities at rig system 400B. In some embodiments, such confirmation tool may have pre-programmed limits of various inputs that may be measured in particular operations (i.e., vibrations, bending, or torsional oscillations). As such, the downhole confirmation tool 460 may send signals back to surface once such reading limits are exceeded, giving the indication to the driller for adjusting input parameters to stay within most optimal parameters down the hole. In some embodiments, no signals will be sent but data will be reviewed once the tool will be retracted back to surface and the adjustments will be performed in later wells. Further, the inputs and measurements made by rig systems 400A and 400B and any other rigs that have copied the drilling inputs from rig system 400A may be capable to share data with the reference DGAS or other comparison device to measure the level of deviations in input and measurements at the surface. If there are large differences of surface measurements outputs appear between rig systems 400A and 400B when having similar surface parameter inputs (i.e., SDCT 410 from rig system 400B has measured larger vibrations than SDCT 410 from rig system 400A by 20% a drill stem re-calibration actions might be taken), one of the rig systems may be designated as a main rig system such that the drilling inputs may be changed at the other rig system. In such re-calibration actions a DDCT 440 might be moved to rig system 400B to re-generate operational parameters heat maps using rig system 400B to confirm the drilling inputs changes.

In some embodiments, the re-generated heat map from rig system 400B may be sent back to rig system 400A and compared. More heat maps may allow corresponding DGAS 420 to find a best operational location to drill particular hole sections for additional rig systems 400D to 400N (not shown), which may not be equipped with the DDCT 440. In some embodiments, when rig systems 400D to 400N may be fitted with the downhole confirmation tool 460 and received information relating to drilling parameter deviations from the bottom of their respective holes, it may be easier to test other proven inputs from previous heat maps generated in the area to return to the most optimal drilling parameters for these rig systems. Input parameters such as WOB, Torque, and RPM may be controlled by drilling personnel (i.e., a driller or engineer)—as per normal drilling operations. For example, the drilling personnel may receive raw or processed readings from additional sensors mounted on the SDCT 410. Such readings may indicate the deviation from the readings from rig system 400A and therefore indicate deviation from the drill stem behavior at rig system 400A. In some embodiments, an automated driller may be used to input parameters into the automated drilling console. In other embodiments a different set of parameters may be used to program the automated driller. For example, machine learning algorithms operating as an automated driller may modify drilling parameters based on surface collected data, such as surface vibrations or surface torque oscillation. Further, the automated driller may adjust the input of WOB, ROP, or Torque as a result such that the rig system 400A may automatically stay within a specific window for achieving an optimal ROP.

Standard communication protocols may be divided into several layers to ensure that sensors/devices, gateways, and actuators are able to communicate by sending and receiving data. These layers may include transport/session, data, network routing/encapsulating, application and data link, and they may play a critical role in communication and management. The raw data acquired by the smart sensors/devices in the rig systems may be preprocessed, filtered, and reconstructed into critical information for presenting in a visual analytics dashboard (for example to the drilling personnel) showing specific issues and solution options. The drilling personnel may then intervene, to manually perform specific tasks, trigger actuators, or let the systems perform an action automatically to solve these problems.

Figure 5:
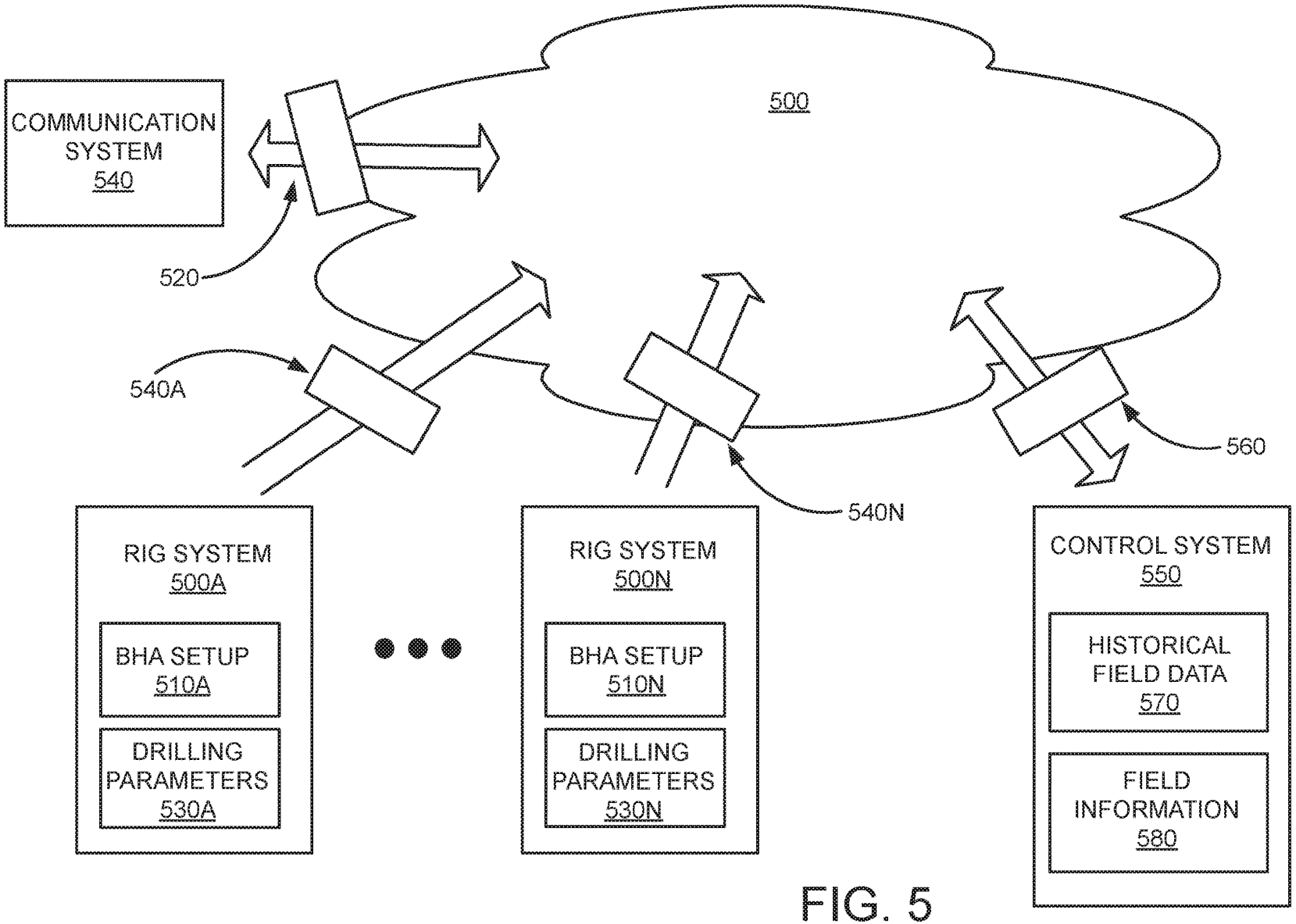
FIG. 5 shows a system according to one or more embodiments.

In one or more embodiments, FIG. 5 shows various communications (for example, cloud services 500 and rig system 500*a* through rig system 500*n*) distributed without pre-existing connections towards one another. The rig systems may be the rig system 100 from FIG. 1, or a combination of rig systems described with respect to FIG. 4. In some embodiments, the rig systems 500A-500N may include a combination of various BHA setups 510A-510N and drilling parameters 530A-530N. The rig systems 500A-500N may transfer feedback information 540A-540N. A standalone communication system 540 may provide context to exchanges between the rig systems 540A-540N and the cloud services 500. Similarly, a standalone control system 550 may provide historical field data 570 and field information 580. As described above, these devices may be distributed in a small area in the field or these devices may be distributed over a distance and at different locations.

Figure 6:
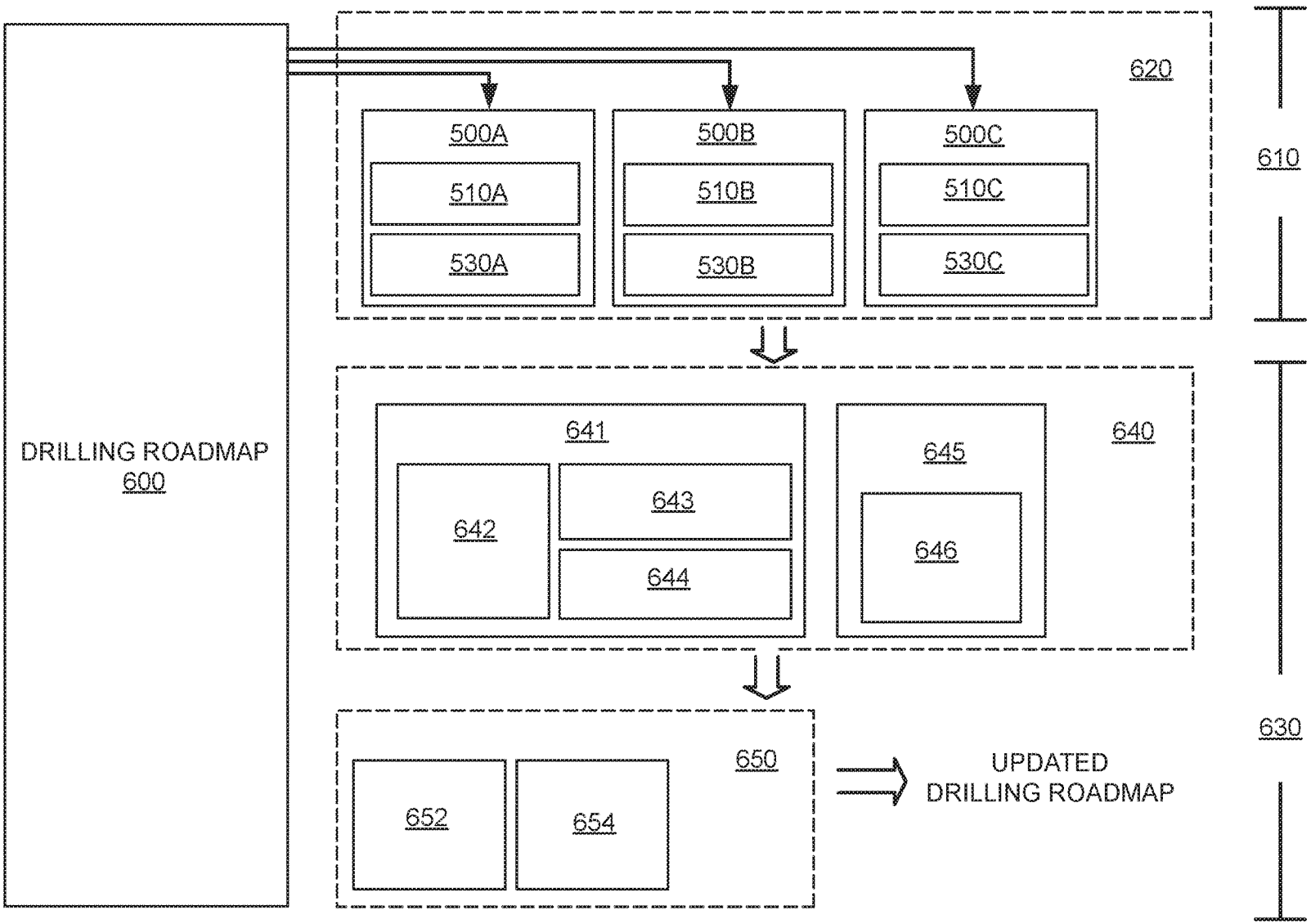
FIG. 6 shows a block diagram of a process in accordance with one or more embodiments.

FIG. 6 shows an example of generating an updated drilling roadmap. Specifically, FIG. 6 shows a process of processing individual rig system information and processing the information to obtain a drilling roadmap that includes instructions and drilling parameters for various rig systems in a field. In particular, a drilling roadmap 600 may be updated by following various parallel processing stages that are performed simultaneously using different processing techniques. For example, the drilling roadmap 600 may be provided to various rig systems 500A-500C. Each rig system may be set with initial instructions for a BHA setup and drilling parameters during an initial drilling roadmap parallel processing stage 620.

As shown in FIG. 6, after completing the initial drilling roadmap parallel processing stage 620, the process of updating the drilling roadmap proceeds to the collected data parallel processing stage 640, and finally to the machine learning validation parallel processing stage 650 to complete the process of alerting.

In regard to the collected data parallel processing stage 640, the rig systems may be provided with historic drilling data 641 and drilling roadmap information 645, which generally describes how the historic drilling data 641 affects current drilling conditions. Specifically, the historic drilling data 641 may include information relating to drilling application types 642, drilling rigs per type 643, and formation locations 644 to contextualize the operations of a specific rig system. Similarly, this processing stage accounts for collected sensory data 646 that may not have been processed under any of the previous collection schemes.

In some embodiments, the information processed and aggregated by the rig systems and other sensors may be validated through a machine learning validation parallel processing stage 650. At this stage, the drilling roadmap is provided with the exact locations of all applications in the field (i.e., both rig locations 652 and locations containing other applications 654).

In some embodiments, a reservoir simulation is divided into one or more obtaining periods (for example, collection period 610) and/or one or more releasing periods (for example, broadcasting period 630). In the obtaining periods, information is collected by the various alerting means from rig system and this information is relayed by their associated communication system. In the releasing periods, processed information may be delivered to one or more destination locations such that the communication systems of each rig system can deliver updated information regarding drilling parameters to appropriately update the drilling roadmap for an entire field of rigs.

Figure 7:
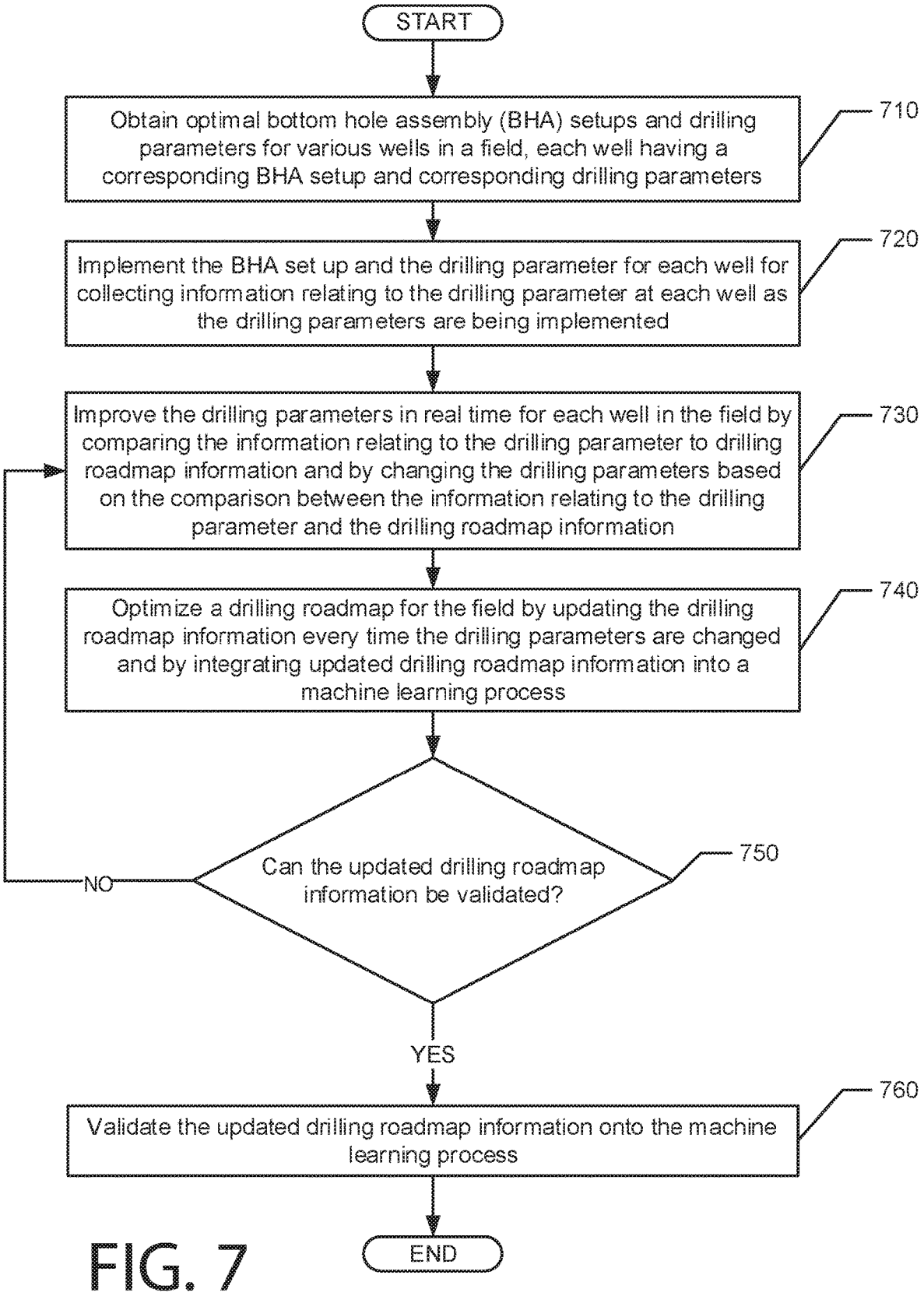
FIG. 7 shows a flowchart in accordance with one or more embodiments.

FIG. 7 shows a flowchart of an embodiment of a method for optimizing a drilling roadmap. One or more blocks in FIG. 7 may be performed by one or more components as previously described in FIGS. 1-6 (for example, the various housings). While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

At 710, optimal BHA setups and drilling parameters may be obtained for various wells in a field. Each well may have a corresponding BHA setup and corresponding drilling parameters. In this case, when developing a new field multiple rigs can be called to the similar location to drill through similar formations at similar depths. In some occasions, such number of rigs can vary between 1 to more than 10. The presented system in this disclosure relies on the number of rigs performing similar activities in the field and, therefore, will work more effectively with an increased number of rigs nearby performing similar operations. Moreover, a larger number of rigs will contribute to data gathering and can be more cost effective.

At 720, the BHA setup and the drilling parameters may be implemented for each well. In this case, information relating to the drilling parameter may be collected as the drilling parameters are being implemented.

At 730, the drilling parameters may be improved in real time for each well in the field by comparing the information relating to the drilling parameter to drilling roadmap information and by changing the drilling parameters based on the comparison between the information relating to the drilling parameter and the drilling roadmap information.

At 740, a drilling roadmap for the field may be optimized by updating the drilling roadmap information every time the drilling parameters are changed and by integrating updated drilling roadmap information into a machine learning process.

At 750, it may be determined whether the updated drilling roadmap information may be validated. Validated, as described above, may refer to providing a machine learning algorithm with relevant statistical resources for deep learning analysis. A validation process includes determining whether the statistical resources and variables in the updated drilling roadmap information are inductive to learning (i.e., that these parameters are relevant to the drilling parameters for maintaining a drilling model with a predetermined ROP). In some instances, the updated drilling roadmap information may not be validated because the information does not contain relevant data that may indicate a change inductive to learning. In such cases, the process may return to improving the drilling parameters as described in 730. In other instances, validation may be possible and the information may proceed to 760.

At 760, the updated drilling roadmap information may be validated onto the machine learning algorithm. In this case, providing the machine learning algorithm with an additional statistical parameter indicates that the conditions that caused the system to consider changes in the drilling parameters will likely include conditions out of the ordinary. As such, the system may improve and learn what the actions were resulting from this incident.

Figure 8A:
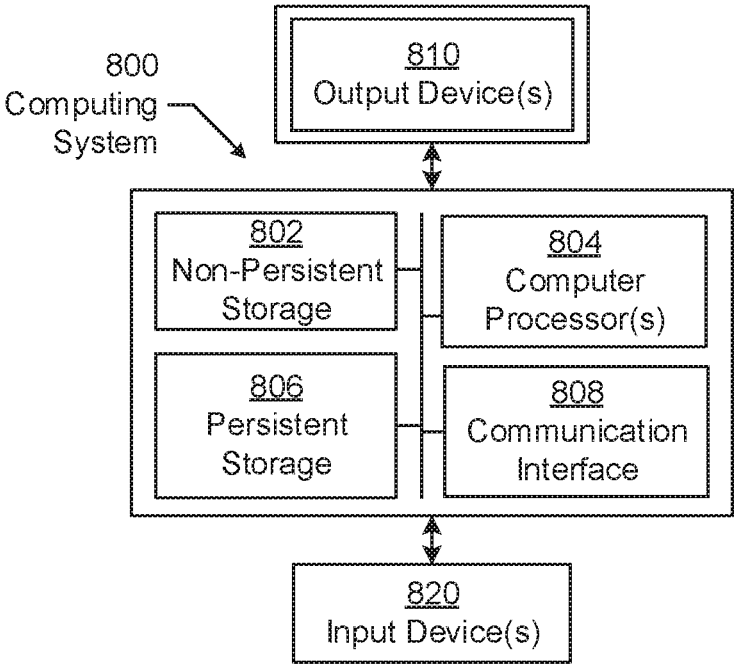
FIGS. 8A and 8B show block diagrams in accordance with one or more embodiments.
Figure 8B:
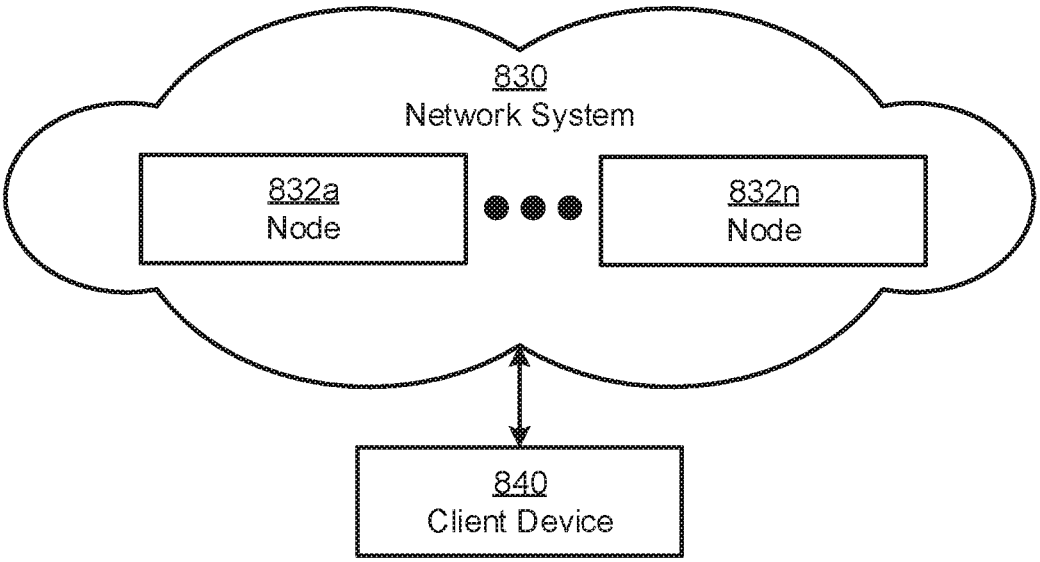

In FIGS. 8A and 8B, embodiments of the invention may be implemented on virtually any type of computing system, regardless of the platform being used. For example, the computing system may be one or more mobile devices (e.g., laptop computer, smart phone, personal digital assistant, tablet computer, or other mobile device), desktop computers, servers, blades in a server chassis, or any other type of computing device or devices that includes at least the minimum processing power, memory, and input and output device(s) to perform one or more embodiments of the invention. For example, as shown in FIG. 8A, the computing system 800 may include one or more computer processor(s) 804, non-persistent storage 802 (e.g., random access memory (RAM), cache memory, flash memory, etc.), one or more persistent storage 806 (e.g., a hard disk, an optical drive such as a compact disk (CD) drive or digital versatile disk (DVD) drive, a flash memory stick, etc.), and numerous other elements and functionalities. The computer processor(s) 804 may be an integrated circuit for processing instructions. For example, the computer processor(s) 804 may be one or more cores, or micro-cores of a processor. The computing system 800 may also include one or more input device(s) 820, such as a touchscreen, keyboard, mouse, microphone, touchpad, electronic pen, or any other type of input device. Further, the computing system 800 may include one or more output device(s) 810, such as a screen (e.g., a liquid crystal display (LCD), a plasma display, touchscreen, cathode ray tube (CRT) monitor, projector, or other display device), a printer, external storage, or any other output device. One or more of the output device(s) may be the same or different from the input device(s). The computing system 800 may be connected to a network system 830 (e.g., a local area network (LAN), a wide area network (WAN) such as the Internet, mobile network, or any other type of network) via a network interface connection (not shown). Many different types of computing systems exist, and the aforementioned input and output device(s) may take other forms.

The computing system 800 in FIG. 8A may be connected to or be a part of a network. For example, as shown in FIG. 8B, the network system 830 may include multiple nodes (e.g., node 832*a*, node 832*n*). Each node may correspond to a computing system, such as the computing system shown in FIG. 8A, or a group of nodes combined may correspond to the computing system shown in FIG. 8A. By way of an example, embodiments of the disclosure may be implemented on a node of a distributed system that is connected to other nodes. By way of another example, embodiments of the disclosure may be implemented on a distributed computing system having multiple nodes, where each portion of the disclosure may be located on a different node within the distributed computing system. Further, one or more elements of the aforementioned computing system 800 may be located at a remote location and connected to the other elements over a network.

The nodes (e.g., node 832*a*, node 832*n*) in the network system 830 may be configured to provide services for a client device 840. For example, the nodes may be part of a cloud computing system. The nodes may include functionality to receive requests from the client device 840 and transmit responses to the client device 840. The client device 840 may be a computing system, such as the computing system shown in FIG. 8A. Further, the client device 840 may include and/or perform all or a portion of one or more embodiments of the disclosure.

The computing system or group of computing systems described in FIGS. 8A and 8B may include functionality to perform a variety of operations disclosed herein. For example, the computing system(s) may perform communication between processes on the same or different systems. A variety of mechanisms, employing some form of active or passive communication, may facilitate the exchange of data between processes on the same device.

The computing system in FIG. 8A may implement and/or be connected to a data repository. For example, one type of data repository is a database. A database is a collection of information configured for ease of data retrieval, modification, re-organization, and deletion. Database Management System (DBMS) is a software application that provides an interface for users to define, create, query, update, or administer databases.

The computing system of FIG. 8A may include functionality to present raw and/or processed data, such as results of comparisons and other processing. For example, presenting data may be accomplished through various presenting methods. Specifically, data may be presented through a user interface provided by a computing device. The user interface may include a GUI that displays information on a display device, such as a computer monitor or a touchscreen on a handheld computer device. The GUI may include various GUI widgets that organize what data is shown as well as how data is presented to a user. Furthermore, the GUI may present data directly to the user, e.g., data presented as actual data values through text, or rendered by the computing device into a visual representation of the data, such as through visualizing a data model.

The above description of functions presents only a few examples of functions performed by the computing system of FIG. 8A and the nodes and/or client device in FIG. 8B. Other functions may be performed using one or more embodiments of the disclosure.

Unless defined otherwise, all technical and scientific terms used have the same meaning as commonly understood by one of ordinary skill in the art to which these systems, apparatuses, methods, processes and compositions belong.

The singular forms "a," "an," and "the" include plural referents, unless the context clearly dictates otherwise.

As used here and in the appended claims, the words "comprise," "has," and "include" and all grammatical variations thereof are each intended to have an open, non-limiting meaning that does not exclude additional elements or steps.

While the apparatus has been described with respect to a limited number of embodiments, those skilled in the art, having the benefit of this disclosure, will appreciate that other embodiments can be devised that do not depart from the scope as described. Accordingly, the scope should be limited only by the accompanying claims.

What is claimed is:

1. A method, comprising:

identifying an optimal bottom hole assembly (BHA) setup for a first plurality of wells, and a second plurality of wells located in a field, wherein each well in the first plurality of wells is configured with at least one downhole data collection tool and is operatively connected to a surface data collection tool, wherein each well in the second plurality of wells is operatively connected to a surface data collection tool, wherein the BHA setup is based on historical simulation data of the field and a drilling roadmap, and wherein the drilling roadmap comprises drilling parameters;

implementing, by drilling, the drilling roadmap at the first plurality of wells;

obtaining sensor collected data from each surface data collection tool and each downhole data collection tool of the first plurality of wells to optimize the drilling parameters of the drilling roadmap;

applying the optimized drilling parameters to the second plurality of wells;

periodically updating the drilling roadmap based, at least in part, on the collected sensor data from the first plurality of wells and data from each surface data collection tool of the second plurality of wells; and using the updated drilling roadmap to drill the first plurality and second plurality of wells in the field.

2. The method as claimed in claim 1, the method further comprising:

transmitting the drilling roadmap to a remote location, the remote location comprising a communication system configured to distribute or broadcast the drilling roadmap to one or more rig systems in the field.

3. The method as claimed in claim 2, wherein each rig system in the field comprises drilling resources for implementing the optimal BHA setup and the drilling parameters according to the drilling roadmap or the drilling roadmap as updated.

4. The method as claimed in claim 3, the method further comprising:

establishing a communication network between the one or more rig systems for exchanging of drilling resources and rig system information, wherein the one or more rig systems may coordinate exchanging of drilling resources to deliver the drilling roadmap and the updated drilling roadmap to every rig system in the field that is connected to the communication network, the drilling resources being shifted between rig systems based on the updated drilling roadmap.

5. The method as claimed in claim 1, wherein the drilling parameters comprise weight on bit, rate of penetration, torque, vibration, drilling fluid hydraulics, and wellbore steering while drilling a directional well.

6. The method as claimed in claim 1, wherein the drilling parameters are obtained using one or more of downhole data collection tools, surface data collection tools, data gathering and analysis systems, and communication systems.

7. The method as claimed in claim 1, further comprising:

comparing data from the surface data collection tools of the first plurality of wells to data from the surface data collection tools of the second plurality of wells;

moving and using a downhole data collection tool from a well in the first plurality of wells to a well in the second plurality of wells if the data from the surface data tool of the well in the second plurality of wells significantly differs from the data of a surface data tool of one or more wells from the first plurality of wells, wherein this well from the second plurality of wells is said to be a re-calibrated well;

optimizing the drilling parameters of the drilling roadmap using data from the surface data collection tool and the downhole data collection tool of re-calibrated well; and updating the drilling roadmap based, at least in part, on the optimized drilling parameters.

8. A method, the method comprising:

obtaining optimal bottom hole assembly (BHA) setups and drilling parameters for a first plurality of wells in a field, each well having a corresponding BHA setup, corresponding drilling parameters, each well operatively connected to a surface data collection tool, and configured with at least one downhole data collection tool;

implementing the BHA setups and the drilling parameters for each well in the first plurality of wells;

tracking the drilling parameters at each well in the first plurality of wells;

obtaining sensor collected data from the surface data collection tool and the at least one downhole data collection tool of each well in the first plurality of wells to determine an accuracy of implementation of the corresponding drilling parameters;

at each well in the first plurality of wells, periodically optimizing the drilling parameters using, at least in part, a machine learning algorithm, the sensor collected data, and the determined accuracy to form an updated drilling roadmap;

using the updated drilling roadmap to drill the wells in the first plurality of wells; and sharing the updated drilling roadmap, with optimized drilling parameters, to a second plurality of wells in the field and drilling the second plurality of wells, wherein each well in the second plurality of wells is without a downhole data collection tool.

9. The method as claimed in claim 8, wherein the BHA setups are based on historical simulation data of the field and drilling roadmap information, and wherein the drilling roadmap information comprises initial drilling instructions for implementing the drilling roadmap.

10. The method as claimed in claim 9, wherein the drilling roadmap is based on a location of the well in the field and a type of other applications being performed in the field.

11. The method as claimed in claim 8, the method further comprising:

transmitting the updated drilling roadmap to a remote location, the remote location comprising a communication system configured to distribute or broadcast the updated drilling roadmap to one or more rig systems in the field.

12. The method as claimed in claim 11, wherein each rig system in the field comprises drilling resources for implementing the BHA setup and the drilling parameters according to the drilling roadmap and the updated drilling roadmap.

13. The method as claimed in claim 8, wherein the drilling parameters comprise weight on bit, rate of penetration, torque, vibration, drilling fluid hydraulics, and wellbore steering while drilling a directional well.

14. The method as claimed in claim 8, wherein the drilling parameters are obtained using one or more of downhole data collection tools, surface data collection tools, data gathering and analysis systems, and communication systems.

15. The method as claimed in claim 8, further comprising:

another machine learning algorithm capable of producing data from a downhole data collection tool using data from a surface data collection tool, wherein the another machine learning algorithm is configured using data from one or more downhole data collection tools and data from one or more surface data collection tools from the first plurality of wells; and using the another machine learning algorithm to produce data corresponding to a downhole data collection tool for each well in the second plurality of wells.

16. A system, comprising:

an oil and gas field;

a first plurality of wells disposed in the field, wherein each well in the first plurality of wells comprises:

one or more downhole data collection tools, a surface data collection tool, drilling parameters, a data gathering and analysis system, and a communications unit;

a second plurality of wells disposed in the field, wherein each well in the second plurality of wells comprises:

a surface data collection tool, drilling parameters, a data gathering and analysis system, and a communications unit, wherein a well in the second plurality of wells may optionally further comprise a downhole confirmation tool;

one or more computers communicably connected to the communication units of the first and second plurality of wells and comprising:

one or more computer processors, a non-transitory computer readable medium storing instructions executable by the one or more computer processors, the instructions comprising functionality for:

receiving sensor collected data from the first plurality of wells;

optimizing, periodically, the drilling parameters for each well in the first plurality of wells; and sharing the optimized drilling parameters with one or more wells in the second plurality of wells.

17. The system of claim 16, wherein each well further comprises an optimal bottom hole assembly (BHA) setup wherein the optimal BHA setup is based on historical simulation data of the field and a drilling roadmap.

18. The system of claim 17, wherein the drilling roadmap comprises initial drilling instructions and the drilling roadmap is updated based, at least in part, on the optimized drilling parameters.

19. The system as claimed in claim 17, wherein each well in the field comprises drilling resources for implementing the optimal bottom hole assembly (BHA) setup and the optimal drilling parameters.

20. The system of claim 16, wherein the non-transitory computer readable medium further comprises instructions comprising functionality for comparing data from the surface data collection tools of the first plurality of wells to data from the surface data collection tools of the second plurality of wells;

wherein a downhole data collection tool from the first plurality of wells may be transferred and used on a well in the second plurality of wells, where this well is said to be a re-calibrated well based, at least in part, on the comparison of data from the surface data collection tools of the first plurality of wells and the data from the surface data collection tool of the re-calibrated well;

wherein the non-transitory computer readable medium further comprises instructions for optimizing the drilling parameters using data from the surface data collection tool and the downhole data collection tool of re-calibrated well; and updating the drilling parameters based, at least in part, on the optimized drilling parameters.

* * * * *